US008201728B2

(12) United States Patent
Forsyth et al.

(10) Patent No.: US 8,201,728 B2
(45) Date of Patent: Jun. 19, 2012

(54) TERMINAL AND DEVICE MANAGEMENT METHOD

(75) Inventors: Gordon A. Forsyth, Perth and Kinross (GB); Philip A. Duncan, Dundee (GB); Jacek Adamski, Warszawa (PL)

(73) Assignee: NCR Corporation, Duluth, GA (US)

( * ) Notice: Subject to any disclaimer, the term of this patent is extended or adjusted under 35 U.S.C. 154(b) by 268 days.

(21) Appl. No.: 12/012,162

(22) Filed: Jan. 31, 2008

(65) Prior Publication Data

US 2009/0194580 A1 Aug. 6, 2009

(51) Int. Cl.
*G07F 19/00* (2006.01)

(52) U.S. Cl. ..... 235/379; 235/375

(58) Field of Classification Search ..... 235/379, 235/375
See application file for complete search history.

(56) References Cited

U.S. PATENT DOCUMENTS

2010/0001062 A1* 1/2010 Drummond et al. ..... 235/379
* cited by examiner

*Primary Examiner* — Karl D. Frech
(74) *Attorney, Agent, or Firm* — Paul W. Martin

(57) ABSTRACT

A self-service terminal (SST), such as an ATM, comprises a processor, and two functionally similar devices, for example cash dispense units, and an input/output (IO) port. The processor receives status data from each of the similar devices and determines which set of status data to communicate to a remote host via the IO port dependent upon device status and health parameters contained within the status data.

16 Claims, 3 Drawing Sheets

TERMINAL AND DEVICE MANAGEMENT METHOD

FIELD OF THE INVENTION

The present invention relates to a terminal and a device management method. More particularly, but not exclusively, it relates to a self-service terminal comprising multiple functionally similar devices and a device management method for managing said multiple functionally similar devices.

BACKGROUND OF THE INVENTION

Common examples of SSTs include automated teller machines (ATMs), information kiosks, financial services centers, bill payment kiosks, lottery kiosks, postal services machines, check-in and check-out terminals such as those used in the hotel, car rental, and airline industries, retail self-checkout terminals, vending machines, and the like.

Many self-service terminals (SST), for example automated teller machines (ATMs), operate under host driven systems. In such a host driven system a remote host communicates with the SST via a defined protocol, such as NCR Direct Connect (NDC) for ATMs. Typically, in the defined protocol the SST communicates status and health data for each device attached to the SST across a network to the host. In a host driven system the host instructs the SST to carry out operations such as dispense cash, print receipts etc., and the SST has little active processing involved in these decisions.

The implementation of a further device, of a type already present on the SST, for example two cash dispense units on a single ATM, requires changes to the protocol implementation at the host. Each device introduced into an SST requires changes to be implemented at the host. As each SST may have different devices replicated upon it the changes to the protocol can be extensive. Such changes are time consuming and expensive for a vendor to implement. Furthermore, any change to the host implemented protocols introduce the opportunity for programming errors to occur which can increase the likelihood of faults.

Currently, it is not possible to provide a mixed network of SSTs with just one device, or multiple instances of functionally similar devices as each type would require a specific host application and associated protocols. This limits the possibility of integration of multiple device SSTs into an existing network.

SUMMARY OF THE INVENTION

According to a first aspect of the present invention there is provided a self-service terminal (SST) comprising a processor, multiple functionally similar devices and an input/output (IO) port, wherein the processor is arranged to receive status data from each of the multiple functionally similar devices and is further arranged to derive combined status data from the multiple functionally similar devices status data to communicate to a remote host via the IO port.

It will be appreciated that the term "multiple" as used herein refers to two or more.

The selective communication of status data to the host obviates the necessity for changes to the host's communication protocol that are required to deal with multiple, similar, component devices of a SST.

The processor may be arranged to select one of the multiple functionally similar device's status data to form the combined status data. The processor may be arranged to select the status data of the device that has the best operational status to form the combined status data.

The communication of only a single device's status to the host allows the integration of a multiple device SST into an existing network of single device SSTs.

The processor may be arranged to determine which device's status data to communicate to the remote host based upon a comparison of parameter values within the status data. The status data may comprise at least one of the following: operational status, fault recorded, bill count, dispense count, transaction status (success or failure of command sent to device(s), supplies (replenishment) and fitness (severity) information.

The processor may be arranged to vary the status data communicated to the host dependent upon the relative status of the multiple functionally similar devices.

The processor may be arranged to select one of the multiple functionally similar devices to service a request received by the terminal from the host. The processor may be arranged to select the one of the multiple functionally similar devices to service the request based upon a comparison of the status data. The processor may be arranged to select the one of the multiple functionally similar devices to service the request that is best placed to service the request based upon the comparison of the status data. The processor may be arranged to instruct the selected one of the multiple functionally similar devices to service the request received from the host.

The multiple functionally similar devices may be functionally identical. The multiple functionally similar devices may be structurally the same.

According to a second aspect of the present invention there is provided a method of device management comprising the steps of:

receiving status data from each of multiple functionally similar devices at a processor; and deriving, at the processor, combined status data, from multiple functionally similar devices' status data, to communicate to a remote host.

The method may comprise determining, at the processor, which of the multiple functionally similar devices' status data to communicate to the remote host as the combined status data. The method may comprise communicating the status data of the device that has the best operational status to the host.

The method may comprise deriving the combined status data based upon a comparison of parameter values within the status data. The status data may comprise at least one of the following: operational status, fault recorded, bill count, dispense count, transaction status (success or failure of command sent to device(s), supplies (replenishment) and fitness (severity) information.

The method may comprise varying the combined status data communicated to the host dependent upon the relative status of the multiple functionally similar devices.

The method may comprise selecting one of the multiple functionally similar devices to service a request received by the terminal from the host. The method may comprise selecting the one of the multiple functionally similar devices to service the request based upon a comparison of the status data.

The method may comprise selecting the one of the multiple functionally similar devices to service the request that is best placed to service the request based upon the comparison of the status data. The method may comprise instructing the selected one of the multiple functionally similar devices to service the request received from the host.

The method may comprise providing the multiple functionally similar devices and the processor as components of a SST.

The multiple functionally similar devices may be functionally identical. The multiple functionally similar devices may be structurally the same.

According to third aspect of the present invention there is provided software, which when executed on processor, causes the processor to receive status data from each of multiple functionally similar devices and to derive combined status data from the multiple similar devices' status data to communicate to a remote host.

The software, when executed on a processor, may be arranged to determine which of the multiple similar devices' status data to communicate to a remote host as the combined status data. The software may cause the processor to communicate the status data of the device that has the best operational status to the host.

The software may cause the processor to derive the combined status data based upon a comparison of parameter values within the status data.

The software may cause the processor to vary the combined status data communicated to the host dependent upon the relative status of the multiple functionally similar devices.

The software may cause the processor to select one of the multiple functionally similar devices to service a request received by the terminal from the host. The software may cause the processor to select the one of the multiple functionally similar devices to service the request based upon a comparison of the status data. The software may cause the processor to select the one of the multiple functionally similar devices to service the request that is best placed to service the request based upon the comparison of the status data. The software may cause the processor to instruct the selected one of the multiple functionally similar devices to service the request received from the host.

The software may be arranged to run on a processor of an SST.

According to a fourth aspect of the present invention there is provided a data carrier bearing instructions, which, when executed, cause a processor to perform the method of the second aspect of the present invention.

According to a fifth aspect of the present invention there is provided a processor arranged to screen one of multiple similar devices from access by a remote host.

According to a sixth aspect of the present invention there is provided a SST comprising a processor according to the fifth aspect of the present invention and the multiple similar devices.

According to a seventh aspect of the present invention there is provided a SST comprising multiple functionally similar devices and a processor, the processor being arranged to selectively present only one of the multiple functionally similar devices to a remote host.

BRIEF DESCRIPTION OF THE DRAWINGS

Embodiments of the present invention will now be described, by way of example only, with reference to the accompanying drawings, in which:

Referring now to FIGS. 1 and 2, a self-service terminal, in the present example an ATM 100, comprises a chassis 102, a plastic fascia 104, a core processing unit 106 and peripheral devices 108*a-h*. Some of the peripheral devices are replicated within the ATM 100.

Figure 1:
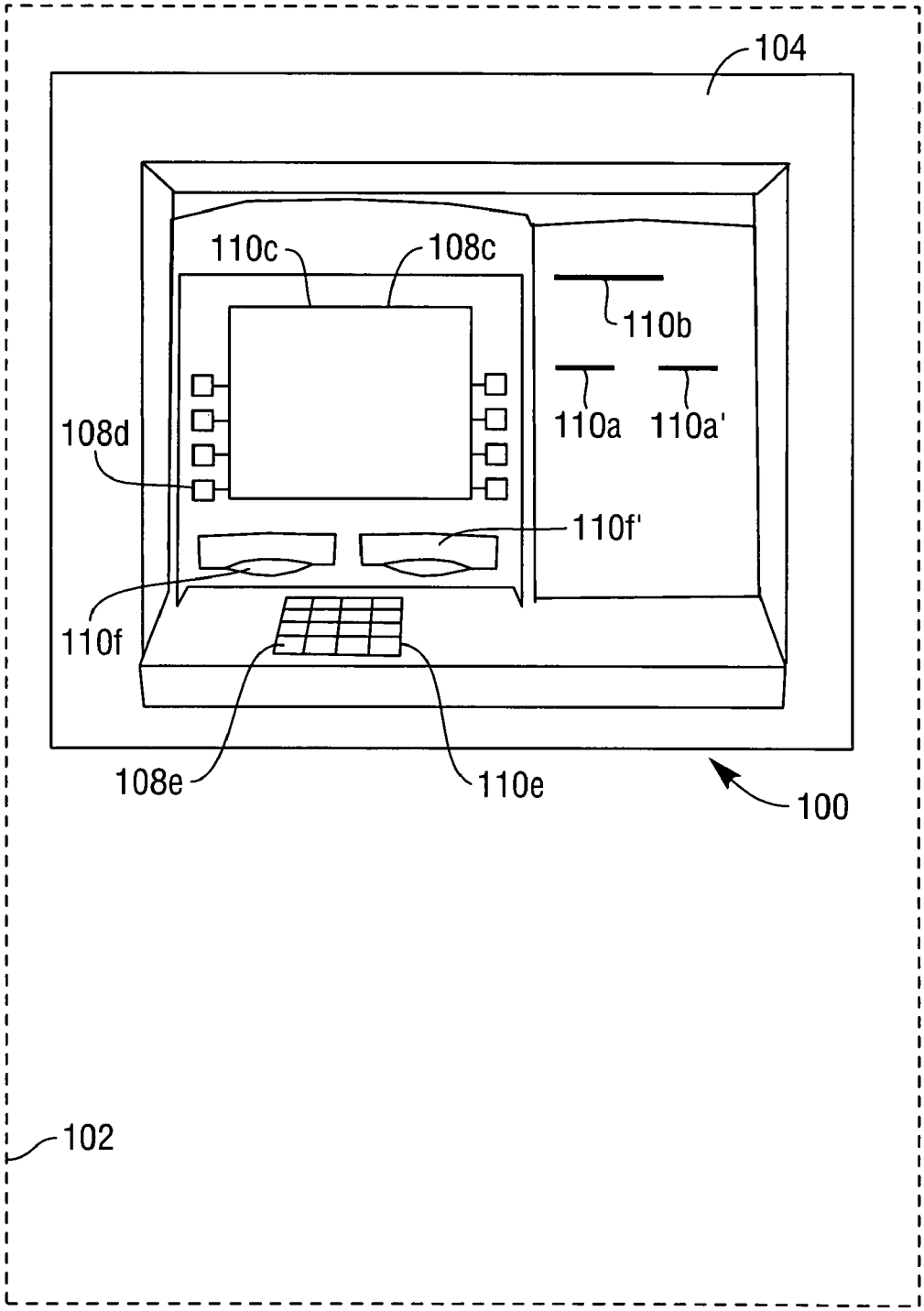
FIG. 1 is a front elevation of an embodiment self-service terminal according to an aspect of the present invention.
Figure 2:
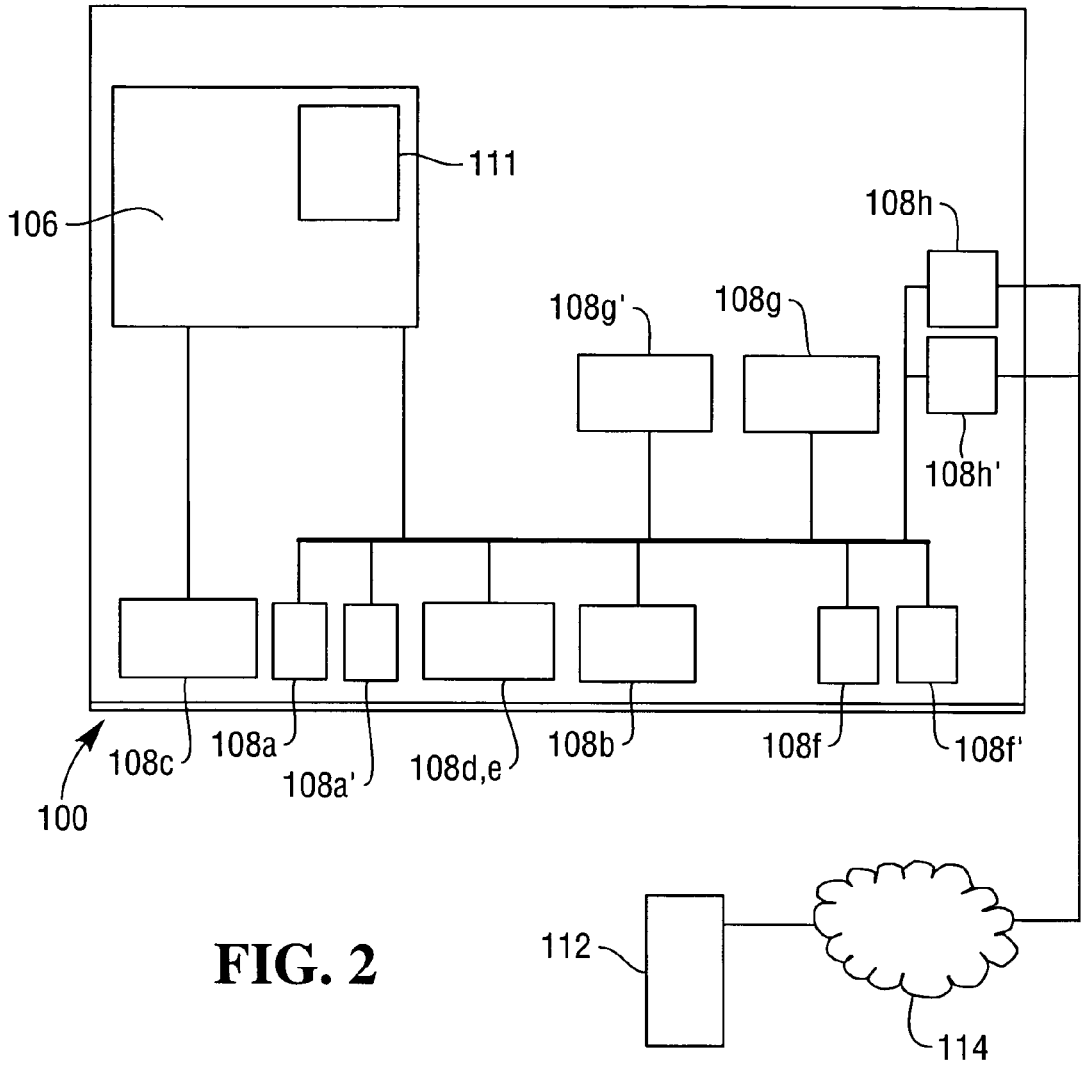
FIG. 2 is schematic diagram of the internal components of the SST of FIG. 1.
Figure 3:
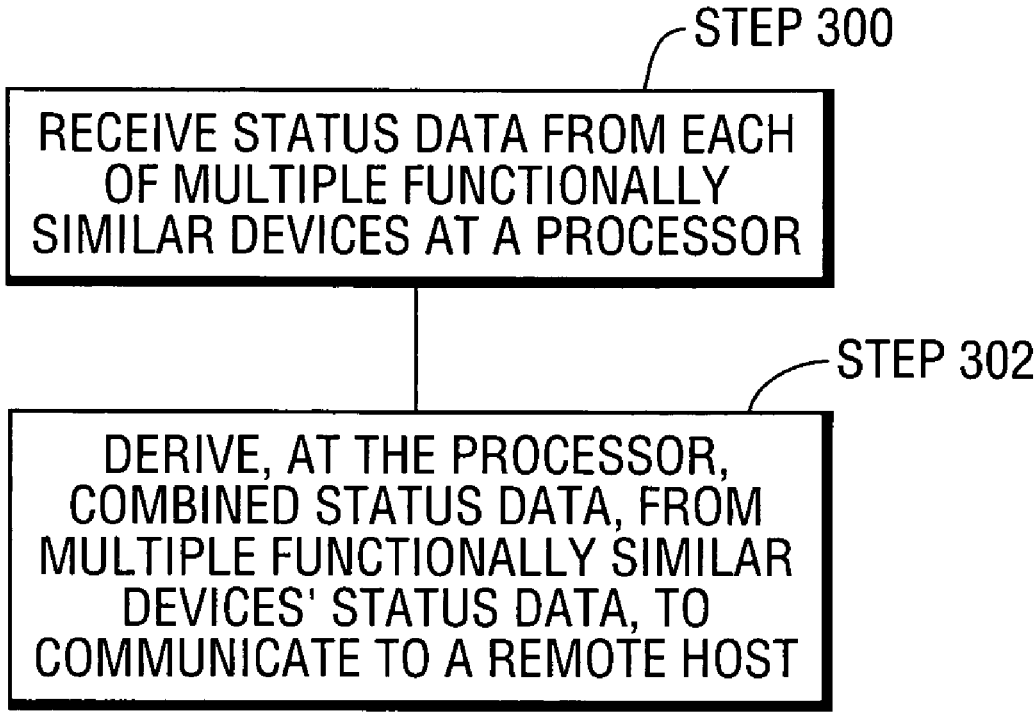
FIG. 3 is a flowchart showing the steps of a device management method according to another aspect of the present invention.

The fascia 104 has apertures that align with some of the peripheral devices 108 when the fascia 104 is closed. In particular, the fascia 104 defines card reader slots 110*a*, 110*a*' aligned with card reader devices 108*a*, 108*a*'; a receipt printer slot 110*b* aligned with a receipt printer device 108*b*; a display aperture 110*c* aligning with a display 108*c* and associated function display keys (FDKs) 108*d*; a keypad aperture 110*e* through which an encrypting keypad device 108*e* protrudes; and dispenser slots 110*f*, 110*f* aligned with a dispenser device 108*f*, 108*f*.

Typically, the core processing unit 106 is a PC processing core operating under, for example, Microsoft Windows XP™ operating system. The core processing unit 106 controls the operation of the ATM 100, including the operation of the peripheral devices 108*a-h*.

The core processing unit 106 has status filter software 111 running upon it.

A number of the peripheral devices 108*a-h* reside internally of the ATM 100. Typically, these devices include: journal printer devices 108*g*, 108*g*' for creating a record of transactions executed by the ATM 100, network connection devices 108*h*, 108*h*' for accessing a remote host 112 via a network 114. Typically, the network 114 is a private network or a virtual private network.

In the present embodiment, the host 114 monitors the status of the ATM 100. The host 114 also acts as an authorization host to authorize customer's transaction requests and instruct the dispensing of cash.

The unreplicated peripheral devices such as the receipt printer 108*b*, screen 108*c*, FDKs 108*d* and encrypted keypad device 108*e* report their current status periodically to the remote server 112 via the core processing unit 106 in a manner known to those skilled in the art.

In the case of the replicated peripheral devices, such as the card reader devices 108*a*, 108*a*', the dispenser devices 108*f*, 108*f*, the journal printer devices 108*g*, 108*g*' or the network connection devices 108*h*, 108*h*', status data passes from each of the two replicated devices to the core processing unit 106. The filter software 111 running on core processing unit 106 compares parameters within the status data to determine the relative status' of the two replicated devices. For example, in the case of the dispenser devices 108*f*, 108*f*' the parameters compared by the core processing unit 106 may include dispense motor status, shutter status and number of bills remaining for dispense. Thus, if the motor of a first dispenser device 108*f* is faulty, and the motor of the second dispenser device 108*f*' is operating normally, the filter software 111 compares the motor status parameter within the status data received from both the dispenser devices 108*f*, 108*f*'. The software 111 compares each parameter within the status data to determine an overall operability score or measure for each of the replicated devices.

In some embodiments, the software 111 may weight the parameters dependent upon their relative importance. For example, in the case of the dispenser devices 108*f*, 108*f*' a faulty shutter may be given a weighting of 1 as this will prevent operation of a dispenser device 108*f*, 108*f*', whereas a low level of bills for dispense may be given a weighting of 0.5 as this will not immediately prevent the operation of the dispenser device 108*f*, 108*f*'.

Alternatively, or additionally, each peripheral device 108 may be assigned a pre-determined, or dynamic, priority value. For example, if a first dispenser device 108*f* is worse placed to fulfill a customer's request than the second dispenser device 108*f'* the relative priority values of the two dispenser devices 108*f*, 108*f'* may dictate that the first dispenser device 108*f* is used to dispense bills in preference to the second dispenser device 108*f'*.

In a further example, the fulfillment of an authorized transaction would leave the second dispenser devices 108*f'* with a low stock of a particular type of bill and may have to go offline if it fulfilled the authorized transaction. The first dispenser device 108*f* may have a stock of the require bills sufficient to fulfill the transaction and remain in operation. Accordingly, the software 111 will instruct the fulfillment of the authorized transaction from the first dispenser 108*f* in order to prolong the period before replenishment of the second dispenser 108*f'* is necessary.

The priority values assigned to each device may be static, i.e. pre-determined, or they may be dynamic. If the priority values assigned to each of the peripheral devices are dynamic they can be based upon factors such as the replenishment levels of cassettes of a dispense device as detailed hereinbefore, or any dynamic parameter appropriate to the particular replicated device. The use of such priority values is particularly useful where the parametric comparison of replicated devices status' indicates that the replicated devices' status are the same, or similar, as the priority values provide a measure by which selective reporting and operation of multiple devices can be effected.

The core processing unit 106, using the software 111, compares the status data from each of the replicated devices and determines which of the replicated devices' status data is to be communicated to the remote host 114. Typically, the core processing unit 106 and the filter software 111 are configured to select the status data of the replicated device that is in the best position to fulfill as user request to the remote host 114. The core processing unit 106 outputs the selected status data to the remote host 114 via one of the network connection devices 108*h*, 108*h'*. The communication of the selected status data to the remote host 114 is achieved using the standard defined protocol for doing so, for example NDC.

It will be appreciated that, although shown with replicated devices presenting to a customer via separate apertures, in some configurations replicated devices may present to a customer via a single aperture.

It will be appreciated that the core processing unit 106 may be arranged to vary the content of the status data transferred to the remote host 114. For example, the first dispense device 108*h* may have a faulty shutter that prevents its use and the second dispense device 108*h'* may have a low level of bills available for dispense. Whilst the ATM 100 can currently service customer requests by using the second dispense device 108*h'*, the core processing unit may output a "Warning" status to the remote host 114 rather than a "System OK" status. This is because the ATM 100 may have a limited number of dispenses available prior to requiring either, or both, of the shutter fault being remedied and replenishment of the second dispense device 108*h'*. The intelligence built into the core processing unit 106 by the filter software 111 allows this to be achieved.

When the remote host 114 requests that the ATM 100 carries out an action, for example, the dispensing of bills from the ATM 100, the core processing unit 106 and the software 111 compare the parameters of the replicated device to be used in fulfilling the host's request and determines which of the replicated devices is best placed to fulfill the host's request. The core processing unit 106 then controls the fulfillment of the host's request using, in the present example, the dispense device 108*h*, 108*h'* that is best placed to fulfill the host's request, i.e. bills are dispensed from the dispense device 108*h'* selected by the core processing unit 106.

It will be appreciated that although described primarily with reference to a replicated dispense device this is exemplary only, and the present invention may be implemented in respect of any replicated functionally similar devices.

It will be further appreciated that any component device of the ATM 100 may be replicated, including those not described as replicated in the present embodiment, for example the keypad, the screen, the FDKs and the receipt printer, may be replicated. Any component device of the ATM 100 that is replicated can have its status data communication managed by the present invention.

It will be further appreciated that although described with reference to the software 111 the present invention may be realized through a discrete or integrated hardware implementation by way of circuitry in a status data filter unit. Such a unit may be implemented either within, or separately from the core processing unit 106.

It will be appreciated that although described with reference to an ATM the present invention can be applied to any suitable self-service terminals, for example medical record entry terminals or self-check in/out terminals.

A method of device management comprises the steps of receiving status data from each of multiple functionally similar devices, for example dispense devices, at a processor (Step 300). The processor then derives combined status data, from multiple functionally similar devices' status data, to communicate to a remote host (Step 302).

Various modifications may be made to the above described embodiment within the scope of the invention without departing from the spirit of the invention.

The invention claimed is:

1. A self-service terminal (SST) for completing a self-service transaction comprising a housing containing a processor, multiple functionally similar devices and an input/output (IO) port, wherein the processor is arranged to receive individual status data from each of the multiple functionally similar devices, to derive combined status data from the individual status data, to communicate the combined status data to a remote host via the IO port, to receive a request to perform a function from the remote host as part of the self-service transaction, and to select one of the multiple functionally similar devices to service the request received from the remote host during the self-service transaction.

2. The SST of claim 1, wherein the processor is arranged to select individual status data from only one of the multiple functionally similar devices device's status data to form the combined status data.

3. The SST of claim 2, wherein the processor is arranged to select the individual status data from of the one device to form the combined status data based upon the one device having that has the a best operational status to form the combined status data of the multiple functionally similar devices.

4. The SST of claim 1, wherein the processor is arranged to derive the combined status data based upon a comparison of parameter values within the individual status data of the multiple functionally similar devices.

5. The SST of claim 1, wherein the processor is arranged to vary the combined status data communicated to the host dependent upon the relative a comparison of the individual statuses status of the multiple functionally similar devices.

6. The SST of claim 1, wherein the processor is arranged to derive the combined status data by selecting the individual status data of the one multiple functionally similar device.

7. The SST of claim 1, wherein the processor is arranged to select the one of the multiple functionally similar devices to service the request that is best placed to service the request based upon the a comparison of the individual status data of the multiple functionally similar devices showing that the one of the multiple functionally similar devices is best placed to service the request.

8. The SST of claim 1, wherein the multiple functionally similar devices are functionally identical peripherals in the SST.

9. The SST of claim 1, wherein the multiple functionally similar devices are structurally similar the same.

10. A method of device management comprising the steps of:

receiving individual status data from each of multiple functionally similar devices in a self-service terminal by a processor of the self-service terminal;

deriving, by the processor, combined status data, from the individual status data, to communicate to a remote host;

receiving a request from the remote host by the processor during a transaction at the self-service terminal;

comparing the individual status data by the processor; and selecting one of the multiple functionally similar devices to service the request from the remote host during the transaction based upon a comparison of the individual status data.

11. The method of claim 10, the deriving step comprising determining, by the processor, which of the individual status data to communicate to the remote host as the combined status data.

12. The method of claim 10, the deriving step comprising determining that the one multifunctionally similar device has a best operational status of the multiple functionally similar devices and choosing the individual status data of the one multiple functionally similar device.

13. The method of claim 10, the deriving step comprising deriving the combined status data based upon a comparison of parameter values within the individual status data of the multiple functionally similar devices.

14. The method of claim 10, the deriving step comprising varying the combined status data dependent upon a comparison of the individual statuses of the multiple functionally similar devices.

15. A computer program product, comprising a computer usable medium having a computer readable program code embodied therein, said computer readable program code adapted to be executed to implement a method of device management, said method comprising:

receiving individual status data from each of multiple functionally similar devices in a self-service terminal by a processor of the self-service terminal;

deriving, by the processor, combined status data, from the individual status data, to communicate to a remote host;

receiving a request from the remote host by the processor during a transaction at the self-service terminal;

comparing the individual status data by the processor; and selecting one of the multiple functionally similar devices to service the request from the remote host based upon a comparison of the individual status data.

16. A SST comprising a housing containing multiple functionally similar devices and a processor, the processor being arranged to selectively present only one of the multiple functionally similar devices to a remote host and to selectively use only the one multiple functionally similar device to service a request received from the remote host during a self-service transaction at the SST.

* * * * *